US006969014B2

(12) United States Patent
Bauer et al.

(10) Patent No.: US 6,969,014 B2
(45) Date of Patent: Nov. 29, 2005

(54) TWO-SUBSTANCE SPRAY NOZZLE

(75) Inventors: Emmerich Bauer, Schwaebisch Gmuend (DE); Reinhard Gaa, Metzingen (DE); Dieter Kelz, Dettingen (DE)

(73) Assignee: Lechler GmbH, Metzingen (DE)

( * ) Notice: Subject to any disclaimer, the term of this patent is extended or adjusted under 35 U.S.C. 154(b) by 0 days.

(21) Appl. No.: 10/830,425

(22) Filed: Apr. 23, 2004

(65) Prior Publication Data

US 2004/0262429 A1 Dec. 30, 2004

(30) Foreign Application Priority Data

Apr. 24, 2003 (DE) ..... 103 19 582

(51) Int. Cl.[7] ..... B05B 7/06; B05B 7/04; A62C 5/02; A62C 31/00; A62C 5/00

(52) U.S. Cl. ..... 239/432; 239/8; 239/433; 239/398

(58) Field of Search ..... 239/432, 433, 239/398, 421, 423, 434, 434.5, 8

(56) References Cited

U.S. PATENT DOCUMENTS

| | | | | |
|---|---|---|---|---|
| 3,693,886 A | | 9/1972 | Conrad | |
| 4,349,156 A | | 9/1982 | Haruch et al. | |
| 4,982,716 A | * | 1/1991 | Takeda et al. | 123/531 |
| 5,035,358 A | * | 7/1991 | Katsuno et al. | 239/403 |
| 5,295,628 A | * | 3/1994 | Zuckschwerdt | 239/590.5 |
| 5,553,785 A | * | 9/1996 | Haruch | 239/432 |
| 5,732,885 A | * | 3/1998 | Huffman | 239/416.5 |
| 5,904,299 A | * | 5/1999 | Hans et al. | 239/408 |

FOREIGN PATENT DOCUMENTS

| | | |
|---|---|---|
| DE | OS 22 52 218 | 5/1973 |
| DE | 31 31 070 C2 | 4/1982 |
| DE | 198 22 607 A1 | 11/1998 |
| DE | 198 12 241 A1 | 10/1999 |
| DE | 201 06 613 U1 | 7/2001 |
| JP | 57-94361 | 6/1982 |

OTHER PUBLICATIONS

German Office Action.

* cited by examiner

*Primary Examiner*—David A. Scherbel
*Assistant Examiner*—Darren Gorman
(74) *Attorney, Agent, or Firm*—Crowell & Moring LLP

(57) ABSTRACT

A two-substance spray nozzle includes a mixing chamber in which a target body is provided, against which the liquid stream strikes. The target body is configured as a spreader aligned coaxial with the liquid stream and expanding in the direction of flow up to a spill-over rim, which can be especially conical. The feed passages for the gaseous medium discharge in the direction of flow before the spill-over rim, so that the compressed air delivered can uniformly divide the liquid stream dispersed in the form of a liquid film into fine drops in an effective manner.

11 Claims, 1 Drawing Sheet

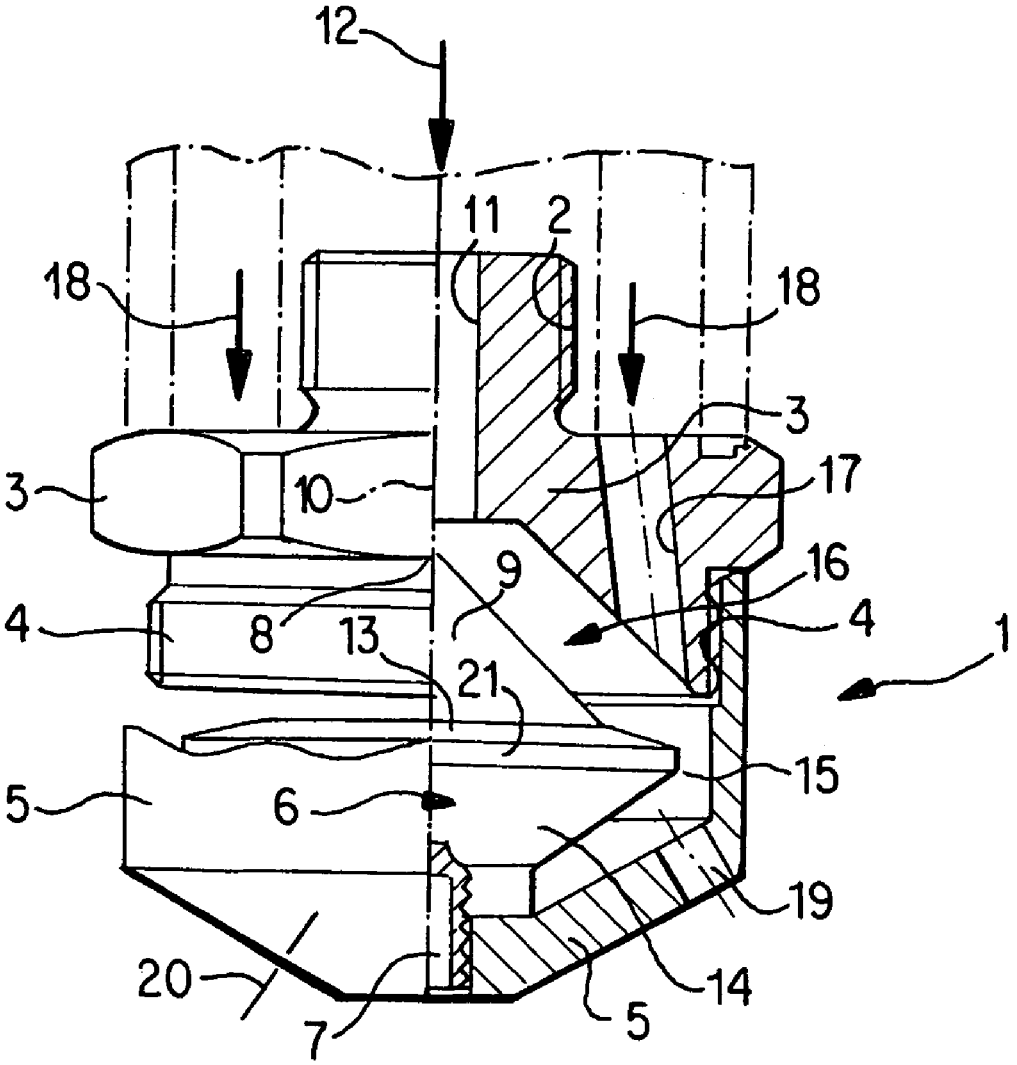
12
11
2
18
18
3
3
10
17
16
9
4
8
13
4
1
21
15
5
6
19
20
14
7
5

TWO-SUBSTANCE SPRAY NOZZLE

This application claims the priority of German Patent Document No. 103 19 582.3, filed Apr. 24, 2003, the disclosure of which is expressly incorporated by reference herein.

BACKGROUND AND SUMMARY OF THE INVENTION

The invention relates to a two-substance spray nozzle with a mixing chamber disposed in a housing in front of a discharge opening, into which opening feed passages bearing a liquid and a gaseous medium enter and in which a target body is provided, against which target body the liquid stream strikes.

In such two-substance spray nozzles with internal mixing, the gas is introduced in finely divided form into a liquid stream and the more or less homogenous mixture is carried out through the narrowed discharge orifice.

DE 31 31 070 C2 discloses a two-substance spray nozzle that is situated opposite an entry opening for the liquid, where a target table was arranged in a mixing chamber. The face of the target table is disposed in the center of a mixing chamber, perpendicular to the axis of the liquid stream and in line with the delivery axis of the gaseous medium. The liquid stream impinging upon the target table therefore bursts in the mixing chamber and is entrained by the compressed air delivered perpendicularly thereto. The liquid stream is divided as uniformly as possible as it continues through the mixing chamber and then is delivered through a discharge opening lying on the axis of the opening through which compressed air is delivered.

In another type of construction according to DE-OS 22 52 218, the liquid stream impinges at the end of a mixing chamber upon a target plate and is mixed with air which is introduced tangentially into the mixing chamber situated in front of the target plate. The mixture thus produced by the turbulence then enters an annular channel behind the target plate and is delivered to an opening which is followed by a second target plate.

An object of the present invention is a two-substance spray nozzle that can achieve a highly uniform mixture between liquid and gaseous phases, which is not easily achievable and could be achieved only by mixing chamber arrangements which require a comparatively great amount of space.

To achieve this object, a two-substance spray nozzle includes an anvil that is designed as a deflecting body aligned coaxially with the liquid stream. The deflecting body flares out in the direction of flow until it reaches a spill-over rim and has an apex pointed against the flow of the liquid. The passages for feeding the gaseous medium lead into the part of the mixing chamber that surrounds the flaring portion of the deflecting body. With this configuration the liquid entering in the form of a solid jet is divided starting from a spreader apex into a liquid film whose thickness diminishes with increasing diameter of the deflection body. Against this relatively thin liquid film the gaseous medium is directed at the spill-over rim of the deflecting body and breaks it up into fine droplets inside of the nozzle. Since in this kind of configuration the liquid film can be uniformly distributed over the circumference of the deflection body, a largely homogeneous mixture with the air is achieved, which leads to a range of droplet sizes of great uniformity.

In a further development of the invention, the passages feeding the gaseous medium can discharge in the direction of flow upstream of the spill-over rim, and can run approximately parallel to the direction of the flow of the liquid stream. This brings the advantage that the passages carrying both media can be brought to a common junction point, and not perpendicular to one another and not requiring a relatively great amount of space as is the case with two-substance nozzles according to the state of the art.

In an embodiment of the invention, the inside wall of the mixing chamber can run approximately parallel to the contour of the deflecting body, so that the air to be mixed with the liquid can be brought close to the deflection body and to the spill-over rim where mixing with the liquid film ring takes place.

The deflection body can be configured as a pyramid. Simply, however, it can he configured as a cone whose axis coincides with the axis of the delivery of the liquid. In an advantageous embodiment it is also possible to configure the deflection body as a double cone which flares in the direction of flow down to the spill-over rim and then tapers back again. This embodiment, together with the correspondingly narrowing inside wall of the mixing chamber, makes it possible to locate the discharge opening or openings downstream of the spill-over rim. Thus also the mixing area is thereby prescribed, which due to the configuration of the invention, does not, of course, require an excessively great length of flow.

In another embodiment of the invention, the flare angle of the cone can be enlarged in the area of the spill-over rim, so that a circumferential margin will form the greatest diameter. With this measure, the liquid film is deflected into a plane approximately perpendicular to the entering air, which enhances the mixing action.

In a further embodiment of the invention, the discharge port can include a plurality of discharge bores whose number, position and exit angle can be chosen according to the desired spray angle and spray stream. One of the important factors to the invention is the distribution of the delivered liquid into an increasingly thin liquid film and its mixture with the air delivered to the area of the spill-over rim of the deflecting body.

BRIEF DESCRIPTION OF THE DRAWING

The FIGURE illustrates an embodiment of the invention.

DETAILED DESCRIPTION OF THE DRAWING

The FIGURE shows a nozzle head 1 which can be attached to a pipe represented in dash-dotted lines, which is provided with supply passages for a liquid medium and for a gaseous medium. The nozzle head 1 includes a connecting part 3 with the connecting thread 2, and a cap 5 screwed onto a thread 4 of the connecting part 3, which is provided on its interior with a nozzle anvil in the form of a target body 6 which is connected to the cap 5 by a screw 7 or is pressed in place.

The target body 6 includes a rotationally symmetrical double cone 9, 14 wherein the apex 8 of the cone portion 9 facing away from the cap 5 lies on the axis 10 of the nozzle head 1. The target body 6 also includes a central feed bore 11 which feeds the liquid under pressure in the direction of the arrow 12. The cone portion 9 then merges with a frustoconical portion 13 whose pitch from the axis 10 is shallower and merges with a cylindrical ring 21 which forms at its circumference a spill-over rim 15 from which the cone portion 14 tapers downward into the cap 5. Between cap 5 and connecting part 3 and the double conical target body 6, an annular mixing chamber 16 is formed into which feed bores 17 enter to carry the gaseous medium which is fed in the direction of the arrow 18 through the pipe represented by the dash-dotted lines or in some other way. The inside walls of the mixing chamber are approximately parallel to the shape of the target body 6.

The feed bores 17 are approximately parallel to the liquid feed bore 11 and lead into a region of the mixing chamber 16 that is still upstream of the spill-over rim 15.

Also in the cap 5, discharge bores 19 are provided downstream of the spill-over rim 15 and are uniformly distributed on the circumference of the cap 5. The exit angle of these bores 19, measured from the axis 10 of the nozzle head 1, is variable. This is true also of the number of the bores 19 and of their radial distance from the central axis 10. It would also be possible, for example, to situate the discharge bores closer to the axis 10 and to vary the exit angle, as indicated by the axis 20.

The manner of operation of the new nozzle head is as follows:

The liquid enters in the direction of the arrow 12 as a solid stream into the mixing chamber and strikes the apex 8 of the cone 9. The liquid is thereby uniformly distributed onto the surface of the cone 9 and the thickness of the liquid film thus produced decreases with the increasing diameter of the cone 9. At the ring 13 the liquid film is turned to a direction which is virtually perpendicular to the feeding direction of the bores 17. The liquid film is therefore torn into the mixing chamber by the inflowing gaseous medium, uniformly divided into fine droplets, and then carried outside in the form of spray jets through the openings 19. The operation of the fine division of the liquid in the injected air is based on the spreading out of a liquid stream in an annular liquid film which in an especially effective manner is carried along by air streams striking it transversely.

In the illustrated embodiment, the target body is a rotationally symmetrical cone. Alternatively, the illustrated target body can also represent a pyramid-shaped target body, which likewise, starting from a target body apex, distributes the liquid in a film which is then broken up by the inflowing gaseous medium.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A two-substance spray nozzle comprising:

a liquid feed passage;

a gas feed passage;

a discharge opening;

a mixing chamber disposed before the discharge opening and leading into the liquid and gas feed passages;

a target body that has an apex and a spill-over rim and is disposed in the mixing chamber, wherein the target body is designed to be aligned coaxially with a liquid stream from the liquid feed passage and to spread the liquid stream from the apex to the spill-over rim, wherein the liquid stream is spread into a liquid film whose thickness diminishes with increasing diameter of the target body and wherein the gas feed passage is designed to discharge into a portion of the mixing chamber surrounding the liquid stream from the apex to the spill-over rim.

2. A two-substance spray nozzle according to claim 1, wherein the gas feed passage is designed to discharge on to the liquid stream.

3. A two-substance spray nozzle according to claim 1, wherein an inner wall of the mixing chamber is approximately parallel to the contour of the target body between the apex and the spill-over rim.

4. A two-substance spray nozzle according to claim 1, wherein the target body between the apex and the spill-over rim is in the shape of a pyramid.

5. A two-substance spray nozzle according to claim 1, wherein the target body between the apex and the spill-over rim is in the shape of a cone.

6. A two-substance spray nozzle according to claim 5, wherein the target body is in the shape of a double cone which widens from the apex to the spill-over rim and then narrows.

7. A two-substance spray nozzle according to claim 1, wherein the discharge opening includes a plurality of discharge bores disposed downstream of the spill-over rim.

8. A two-substance spray nozzle according to claim 7, wherein the position, the number and the exit angles of the discharge bores are selected according to a desired spray angle and spray stream.

9. A method for making a two-substance spray nozzle, comprising:

disposing a mixing chamber, into which liquid and gas feed passages of the spray nozzle lead, before a discharge opening of the spray nozzle;

disposing a target body, which has an apex and a spill-over rim, in the mixing chamber;

aligning the target body coaxially with a liquid stream from the liquid feed passage to spread the liquid stream from an apex to a spill-over rim of the target body, wherein the liquid stream is spread into a liquid film whose thickness diminishes with increasing diameter of the target body; and aligning the gas feed passage so that it can discharge gas into a portion of the mixing chamber surrounding the liquid stream from the apex to the spill-over rim.

10. A method according to claim 9, further comprising aligning the gas feed passage so that it can discharge gas on to the liquid stream.

11. A method according to claim 9, further comprising arranging an inner wall of the mixing chamber approximately parallel to the contour of the target body between the apex and the spill-over rim.

* * * * *